US005903949A

United States Patent [19]

Halm

[11] Patent Number: 5,903,949

[45] Date of Patent: May 18, 1999

[54] TOOTHBRUSH

[75] Inventor: Hans Halm, Herne, Germany

[73] Assignee: SmithKline Beecham Cosumer Healthcare GmbH, Germany

[21] Appl. No.: 08/913,913

[22] PCT Filed: Mar. 19, 1996

[86] PCT No.: PCT/EP96/01236

§ 371 Date: Oct. 29, 1997

§ 102(e) Date: Oct. 29, 1997

[87] PCT Pub. No.: WO96/28993

PCT Pub. Date: Sep. 26, 1996

[30] Foreign Application Priority Data

Mar. 23, 1995 [GB] United Kingdom ..... 9505914

[51] Int. Cl.[6] ..... A46B 9/04

[52] U.S. Cl. ..... 15/167.1; 15/143.1; 15/172; 15/144.1

[58] Field of Search ..... 15/167.1, 143.1, 15/172, 144.1

[56] References Cited

U.S. PATENT DOCUMENTS

| | | | |
|---|---|---|---|
| 4,829,621 | 5/1989 | Phenegar | 15/172 |
| 5,052,071 | 10/1991 | Halm | 15/167.1 |
| 5,054,154 | 10/1991 | Schiffer et al. | 15/167.1 |
| 5,488,751 | 2/1996 | Gekhter et al. | 15/167.1 |
| 5,673,452 | 10/1997 | Chang et al. | 15/167.1 |
| 5,735,012 | 4/1998 | Heinzelman et al. | 15/167.1 |

FOREIGN PATENT DOCUMENTS

| | | |
|---|---|---|
| 0 336 641 | 10/1989 | European Pat. Off. . |
| 93 10 112 | 6/1994 | Germany . |

*Primary Examiner*—Terrence R. Till
*Assistant Examiner*—Kaj Olsen
*Attorney, Agent, or Firm*—Nora Stein-Fernandez; Janice E. Williams; Charles Kinzig

[57] ABSTRACT

According to this invention, a toothbrush is provided having a head and a handle having a grip portion, disposed along a longitudinal axis, the head having britstles exending from a face thereof ("the bristle face") in a general bristle direction, between the grip portion and the head of the toothbrush there being an integral region of folds having a fold axis in a direction lateral to the longitudinal axis, one or more limbs of the folds being penetrated by an elastomeric material which passes through an aperture in the limb, characterized by the elastomeric material being exposed on both sides of the penetrated limb.

5 Claims, 2 Drawing Sheets

TOOTHBRUSH

BACKGROUND OF THE INVENTION

This invention relates to toothbrushes, in particular to toothbrushes having a flexible region between the head and the handle.

Toothbrushes are known in which there is a flexible region, or a flexibility-modifying region, between the head and the handle. One type of such a toothbrush is disclosed in EP 0336641 A in which there is an integral region of "V"-shaped folds between the head and the handle, of which the flexibility may be modified by mans of a longitudinal core of the plastics material of which the toothbrush is made. Another type of such a toothbrush is disclosed in DE 39 23 495 A, in which there are a series of laterally oriented slots in the handle, filled with an elastomeric material so as to modify the flexibility. WO 92117093 discloses a toothbrush in which the flexibility of the head is modified by the presence of lateral slots filled with an elastomer, and WO 92/17092 discloses a toothbrush in which a flexible link is formed between the head and neck by a cut out, extending between the head and neck, and filled with an elastomer.

SUMMARY OF THE INVENTION

The object of the present invention is to provide a modified, improved, version of such a toothbrush, in which such a folded region is made more effective in modifying the flexibility of the toothbrush, in a construction which enables a folded region of more precisely defined flexibility to be constructed.

According to this invention a toothbrush is provided having a head and a handle having a grip portion, disposed along a longitudinal axis, the head having bristles extending from a face thereof ("the bristle face") in a general bristle direction, between the grip portion and the head of the toothbrush there being an integral region of folds having a fold axis in a direction lateral to the longitudinal axis, one or more limbs of the folds being penetrated by an elastomeric material which passes through an aperture in the limb, characterised by the elastomeric material being exposed on both sides of the penetrated limb.

The invention enables the folded region to be in effect a composite structure of the toothbrush head, handle and fold material, which is preferable a mouldable plastics material, and an elastomeric material. This enables an improved degree of control of the flexibility of the folded region relative to a folded region made without the elastomeric material, e.g. entirely of plastics material. The construction also enables the toothbrush to have an improved degree of flexibility about flex axes such as torsional flexibility.

The fold axis is defined as the axis between the limbs of the folds and extending perpendicular to the plane in which the folds lie. The folds may be substantially "V" or "U" shaped, so that two of such folds joined end to end form a substantially "W" or "S" shaped folded region. The fold axis is preferably in a lateral direction substantially perpendicular to the longitudinal axis of the toothbrush, and also to the general bristle direction. The folded region may for example include between two and seven, preferably five of such folds, on longitudinally alternating sides of the longitudinal axis, in the general manner of the toothbrush of EP 0336641 A.

Preferably all of the limbs are penetrated by the elastomeric material, such that the elastomeric material forms a longitudinal core extending the entire length of the folded region. The aperture(s) in the penetrated fold(s), and hence the elastomeric material in the aperture, may correspond in cross sectional shape to the cross sectional shape of the toothbrush in the penetrated region. The penetrated region is preferably generally quadrilateral, e.g. rectangular or square, which may have rounded corners. The dimensions of the aperture may be a substantial proportion of the cross sectional dimensions of the limb, for example 25% or more, e.g. 50% or more of the width of the limb.

At either or both ends of the folded region the elastomeric material may extend longitudinally beyond the folded region. The elastomeric material may extend to the grip portion of the toothbrush into an integral elastomeric grip pad of the kind disclosed in EP 0336641, the contents of which are included herein by way of reference, for example along a moulding conduit. Towards the head of the toothbrush the elastomeric material may extend into a flexible link between the head and the handle of the toothbrush of the kind disclosed in WO 92/17092 or EP 0613636 A, the contents of which are included herein by way of reference, again for example along a moulding conduit.

The elastomeric material is exposed on both sides of the penetrated limb(s), so as to be present and visible in the concavity of the fold on both sides of the penetrated limb(s). In the concavity the elastomeric material may remain of the same width as it has in the aperture(s), or its width may increase up to substantially the entire width of the concavity.

The aperture(s) may be extended outwards to the outside surface of the outer bend of the folds, i.e. on the other side of the fold from the concavity. On this outer surface the aperture may open into a moulding conduit extending longitudinally, for example linking a grip pad of elastomeric material to a flexible link between the head and the neck of the toothbrush.

The elastomeric material is preferably bonded to the material of the toothbrush where the two are in contact. Suitable elastomeric materials and bonding techniques which can achieve this are known in the art and are used commonly in marketed toothbrushes. The elastomeric material is preferably one which is suitable for use in the grip pad or the flexible link as mentioned above, so that by means of moulding channels a single injection port can be used to injection mould the elastomeric parts of the toothbrush. The elastomeric material is preferably of a contrasting colour to the material of the other parts of the toothbrush, so that the novel construction of the toothbrush can be emphasised by the contrasting appearance. For example the handle and head of the toothbrush may be made of white plastics material, and the elastomeric material may be contrastingly coloured. Suitable plastics materials for the head and handle of the toothbrush are disclosed in EP 0336641 A.

The head and handle of the toothbrush of the invention may be of a known construction. For example the head may have bristles distributed upon its bristle face in discrete tufts, or the bristles may be distributed in a pattern such as that disclosed in PCT/EP 94/02828, the contents of which are included herein by way of reference, and may be linked to the handle by a flexible link as described above, and the handle may have the above-mentioned grip pads.

The toothbrush of this invention may be manufactured using a generally known process, in which a plastics material frame or skeleton is first made by injection moulding, including the folded region and the aperture(s), and the elastomeric material is then injection moulded in under conditions which result in fusion with the plastics material.

The invention therefore in a further aspect provides a process for manufacturing a toothbrush as described herein, in which a plastics material frame or skeleton is made, and elastomeric material is moulded around the frame or skeleton under conditions which result in fusion with the plastics material.

The invention therefore in a further aspect provides a frame or skeleton suitable for use in such a process to manufacture a toothbrush as described herein.

BRIEF DESCRIPTION OF DRAWINGS

The invention will now be described by way of non-limiting example only with reference to the following drawings.

DETAILED DESCRIPTION OF THE INVENTION

Figure 1:
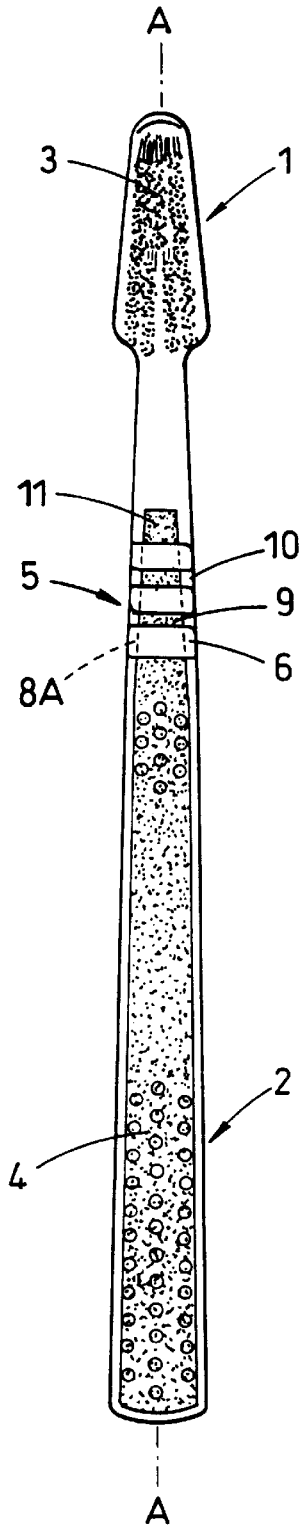
FIG. 1 shows a top view of one embodiment of a toothbrush of this invention.
Figure 2:
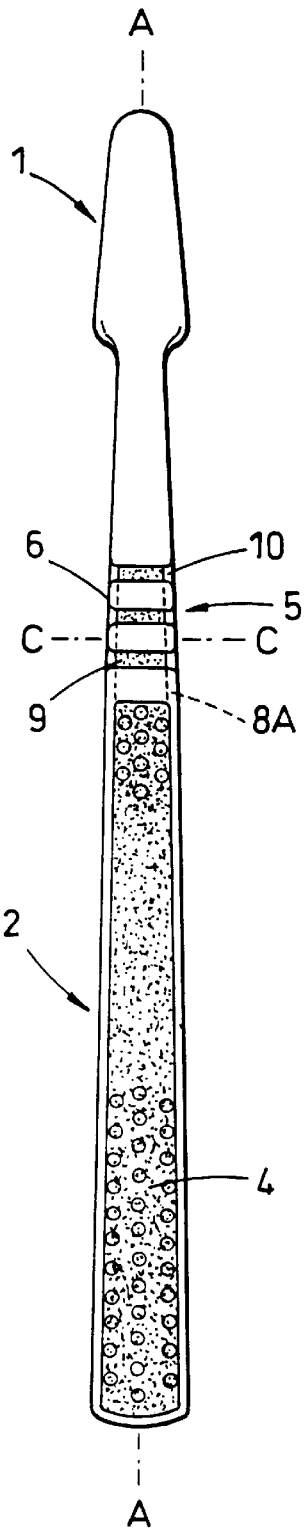
FIG. 2 shows a bottom view of the toothbrush of FIG. 1.
Figure 3:
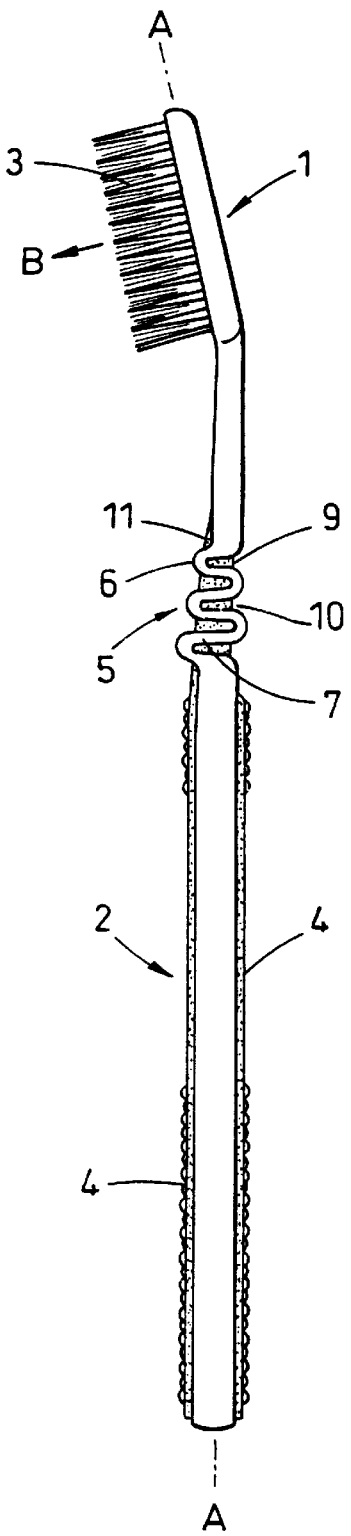
FIG. 3 shows a side view of the toothbrush of FIG. 1.
Figure 4:
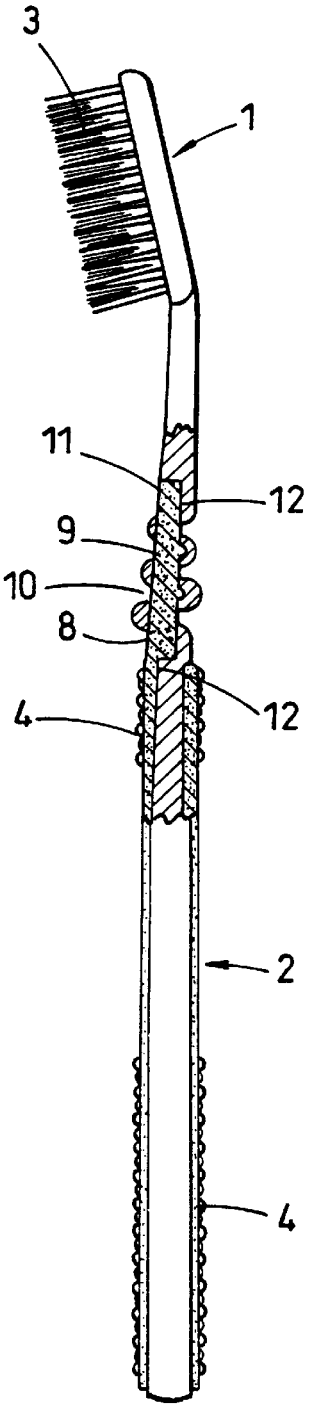
FIG. 4 shows a part longitudinal sectional view of the toothbrush of FIG. 1.

Referring to FIGS. 1 to 5, a toothbrush comprises a bristle bearing head 1 and a handle 2 disposed along a longitudinal axis A—A. The bristles 3 extend from a face of the head 1 in a general bristle direction B. The handle 2 includes elastomeric grip pads 4 of a type as disclosed in EP 0366441 B.

Between the head 1 and the handle 2 is a folded region 5 comprising a number of "U" shaped folds 6, the head 1, handle 2 and region 5 being integrally injection moulded of plastics material. The fold axis C—C extends perpendicular to the longitudinal axis A—A and the general bristle direction B, i.e. out of the plane of FIGS. 3 and 4, this plane being that in which the limbs 7 of the folds lie. Two of the folds joined end to end form an "S" fold.

Each of the limbs 7 has an aperture 8 passing completely through from one side of the limb to the other. The position of the aperture 8 is shown by a dotted line 8A in FIGS. 1 and 2. Passing through each aperture is an elastomeric material 9 in the form of a longitudinal core extending the entire length of the folded region 5. As seen in the cross section at C—C in FIG. 5, the cross sectional shape of the core 9 is quadrilateral, corresponding generally to the cross section of the folded region 5. The elastomeric material 9 is exposed on both sides of the limbs 7, and is present in the concavities 10 between the limbs, where it is of substantially the same width as the apertures 8, although it could extend to substantially the entire width of the adjacent limb 7.

At the end of the folded region 5 facing the handle 2 the elastomeric material 9 extends to integrally join the elastomeric material of the grip pad 4, and at the end of the folded region 5 facing the head 1 the elastomeric material 9 also extends at 11.

The elastomeric material 9 is bonded to the plastics material of the toothbrush, and towards the grip pad 4 and at 11 it, occupies a moulding conduit 12 in the handle. The elastomeric material 9 is of a different and contrasting colour to that of the handle 2.

Figure 6:
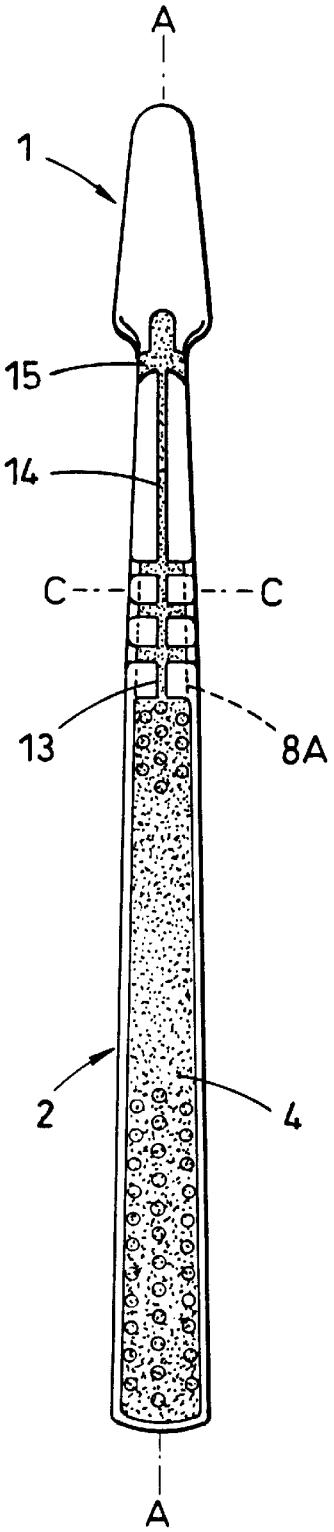
FIG. 6 shows a bottom view of a further embodiment of the toothbrush of this invention.
Figure 7:
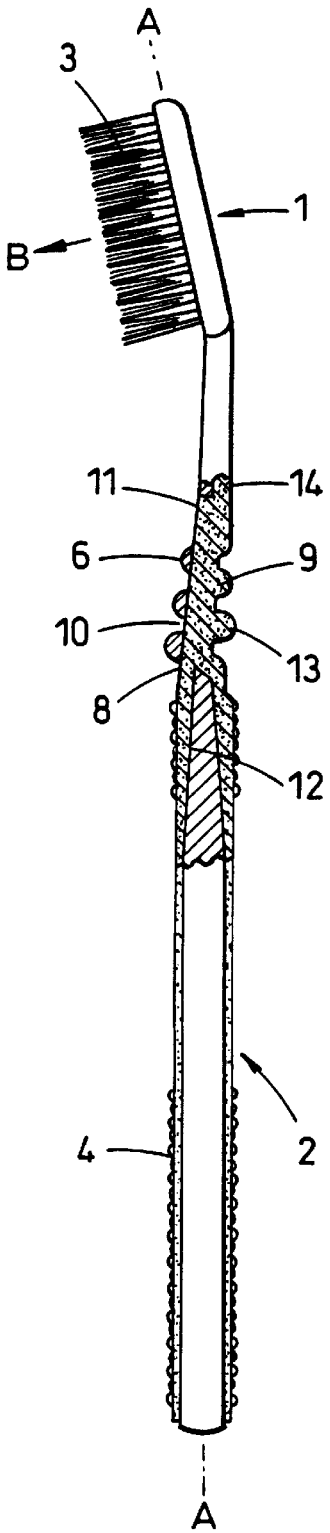
FIG. 7 shows a part longitudinal sectional view of the toothbrush of FIG. 6.
Figure 5:
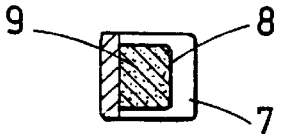
FIG. 5 shows a cross sectional view of the toothbrush of FIG. 1.

Referring to FIGS. 6 and 7, a toothbrush is shown, parts corresponding to features shown in FIGS. 1 to 6 being correspondingly numbered. The position of the aperture 8 is shown with a doted line 8A in FIG. 6. In the toothbrush of FIGS. 6 and 7 the aperture 8 extends in a narrow channel to the outer surface of the folds 6 to form slot shaped moulding conduits 13, filled with the elastomeric material 9, and linking the grip pad 4 and the elastomeric material in the concavities 10. Although shown as narrow slots 13 the conduits 13 could extend to substantially the whole width of the outer surface of the folds 6.

At the end of the folded region 5 facing the head 1 the elastomeric material 9 extends in moulding conduit 14 to integral join a flexible link 15 of the type shown in EP 0613636 A although other types of flexible link are possible. Side views and the top view of the toothbrush of FIGS. 6 and 7 are substantially the same as FIGS. 1 and 3.

The toothbrushes of FIGS. 1 to 7 are made by firstly injection moulding a skeleton of plastics material making up the plastics material parts of the head 1, handle 2 and folded region 5, then moulding in the elastomeric material 9 under conditions such that the elastomeric material and plastics material fuse together and bond.

What is claimed is:

1. A toothbrush having a head (1) and a handle (2) having a grip portion, disposed along a longitudinal axis, the head having bristles (3) extending from a face thereof ("the bristle face") in a general bristle direction, between the grip portion and the head of the toothbrush there being an integral region of folds (5) having a fold axis in a direction lateral to the longitudinal axis, one or more limbs (7) of the folds (6) being penetrated by an elastomeric material (9) which passes through an aperture (8) in the limb, characterised by the elastomeric material (9) being exposed on both sides of the penetrated limb (7).

2. A toothbrush according to claim 1 characterised in that the folds (6) are substantially "V" or "U" shaped, so that two of such folds (6) joined end to end form a substantially "W" or "S" shaped folded region (5), and the fold axis is in a lateral direction substantially perpendicular to the longitudinal axis of the toothbrush, and also to the general bristle direction.

3. A toothbrush according to claim 1 characterised in that all of the limbs (7) are penetrated by the elastomeric material (9), such that the elastomeric material (9) forms a longitudinal core extending the entire length of the folded region (5).

4. A toothbrush according to claim 1 characterised in that the aperture(s) (8) in the penetrated fold(s) (5), and hence the elastomeric material (9) in the aperture (8), corresponds in cross sectional shape to the cross sectional shape of the toothbrush in the penetrated region (5).

5. A toothbrush according to claim 1 characterised in that the dimensions of the aperture (8) are 25% or more of the width of the limb (7).

* * * * *